US005159238A

United States Patent [19]

Koiwa et al.

[11] Patent Number: 5,159,238

[45] Date of Patent: Oct. 27, 1992

[54] GAS DISCHARGE PANEL

[75] Inventors: Ichiro Koiwa; Yoshitaka Terao; Hideo Sawai; Naoyuki Shiozawa; Kozo Fujii, all of Tokyo, Japan

[73] Assignee: Oki Electric Industry Co., Ltd., Tokyo, Japan

[21] Appl. No.: 562,906

[22] Filed: Aug. 6, 1990

[30] Foreign Application Priority Data

| | | | |
|---|---|---|---|
| Aug. 17, 1989 | [JP] | Japan | 1-211785 |
| Dec. 28, 1989 | [JP] | Japan | 1-344068 |
| Jun. 20, 1990 | [JP] | Japan | 2-161894 |

[51] Int. Cl.[5] ..... H01J 17/49

[52] U.S. Cl. ..... 313/582; 313/346 R; 313/584; 313/585

[58] Field of Search ..... 313/346 R, 582, 584, 313/585, 352, 503; 252/518

[56] References Cited

U.S. PATENT DOCUMENTS

| | | | |
|---|---|---|---|
| 3,484,284 | 12/1969 | Dates et al. | 252/518 |
| 3,937,670 | 2/1976 | Semkina et al. | 252/518 |
| 3,943,396 | 3/1976 | Kose et al. | 313/352 |
| 4,249,105 | 2/1981 | Kamegaya et al. | 313/346 R |
| 4,280,931 | 7/1981 | Delsing et al. | 252/518 |
| 4,518,890 | 5/1985 | Taguchi et al. | 313/346 |
| 4,554,482 | 11/1985 | Kamegaya et al. | 313/582 |
| 4,728,581 | 3/1988 | Kane et al. | 313/503 |
| 4,751,152 | 6/1988 | Zymboly | 429/31 |
| 5,041,759 | 8/1991 | Kwon et al. | 313/582 |

OTHER PUBLICATIONS

Patent Abstracts of Japan, No. 60-257035, vol. 10, No. 125, 10th May 1986.

"DC-Plasma Display with $LaB_6$ Cathode by Screen Printing", *ITEJ Technical Report*, vol. 12, No. 49, Nov. 1988, pp. 43-48.

Telsuo Sakai, et al., "Experiments on Cathode Materials for DC Gas-Discharge Color Panel", *Institute of Electronics, Information and Communication Engineers of Japan Technical Report* (Electronic Display) EID 87-37 (Feb. 1988).

*Primary Examiner*—Donald J. Yusko
*Assistant Examiner*—Nimesh Patel
*Attorney, Agent, or Firm*—Spencer, Frank & Schneider

[57] ABSTRACT

A gas discharge panel with a plurality of electrically conductive oxide cathode electrodes and a plurality of anode electrodes that are arranged in a matrix in a sealed container. This electrically conductive oxide cathode electrode is formed using, for example, lanthanum chromite, lanthanum calcium chromite, alumina-doped zinc oxide, or antimony-doped tin oxide.

25 Claims, 10 Drawing Sheets

APPLIED VOLTAGE VS DISCHARGE CURRENT CHARACTERISTICS

APPLIED VOLTAGE VS DISCHARGE CURRENT CHARACTERISTICS

APPLIED VOLTAGE VS DISCHARGE CURRENT CHARACTERISTICS

APPLIED VOLTAGE VS DISCHARGE CURRENT CHARACTERISTICS

APPLIED VOLTAGE VS LUMINANCE CHARACTERISTICS

DISCHARGE CURRENT VS LUMINANCE CHARACTERISTICS

CHROMATICITY CHART

GAS DISCHARGE PANEL

BACKGROUND OF THE INVENTION

FIELD OF THE INVENTION

This invention relates to a gas discharge panel.

DESCRIPTION OF THE PRIOR ART

A gas discharge panel is a piece of equipment with many cathode and anode electrodes arranged in a matrix and hermetically sealed in a container with a gas medium injection. When selected cathodes and anode electrodes have applied to them a specific voltage, there is a discharge in the gas medium between intersecting electrodes which constitute the display cell, to emit a light.

The gas discharge panel has features such as; a wide viewing angle, high contrast ratio, easily visible display because of self-light emission and a thin composition. It is used as a display device in office automation devices, and is expected to be applied to high definition television sets.

This gas discharge panel is divided into an AC driven type and a DC driven type. The DC driven gas discharge panel is characterized by its relatively simple drive circuit. However, because the cathode electrode surface is directly exposed to the discharge space, characteristics of the cathode electrode material directly affect the panel discharge characteristics. Furthermore, because the cathode electrode receives direct ion impingement, the panel life is largely affected by the sputtering of the cathode electrode. Therefore, selecting the cathode electrode material is a critical factor if the characteristics of a DC type gas discharge panel are to be enhanced.

Concerning cathode electrode materials, it is recommendable to select materials with small work functions and low spatter rates. The reason for this is that the lower work function results in a larger secondary electron discharge allowing the use of lower voltage to drive the gas discharge panel. Also, a low sputter rate extends the service life of the gas discharge panel.

Materials having this nature include rare earth compounds (lanthanum, for example), oxides, and nickel, which has a larger work function and a higher sputter rate than the former two.

One gas discharge panel has cathode electrodes structured with lanthanum hexaboride ($LaB_6$), a kind of rare earth compounds as disclosed in a technical report by Television Society, (12, (49), (11. 1988), pp. 43–48). This gas discharge panel successfully drove at a lower voltage than panels using nickel cathode electrodes, but was not satisfactory in terms of service life.

Oxide is not suitable as a cathode electrode material because its electric resistance is too high and turns to a higher grade oxide when baked. Therefore, no gas discharge panels with oxide cathode electrode structures has found practical use.

Such being the case, nickel is currently the most widely used cathode electrode material. In addition, nickel easily forms a thick film by screen printing with nickel paste, and thus, is suitable as a cathode electrode material for large gas discharge panels.

PROBLEMS TO BE SOLVED BY THE INVENTION

However, conventional gas discharge panels using thick nickel film for the cathode electrode material may possibly damage the nickel cathode electrodes due to the sputtering of ions generated from ionization of gases contained in the panel, such as neon and argon. Therefore, such panels are technically unsatisfactory as far as ensuring a long service life is concerned.

Another means of preventing cathode electrodes from being damaged by sputtering, is that mercury can be injected into a panel together with a discharge gas to alleviate ion impact and to prevent local discharge concentration. However, this method requires complicated mercury injection work and thus raises the production cost, makes maintenance of safety more difficult and causes mercury pollution if the panel is destroyed.

In addition, the gas discharge panel with thick nickel film cathode electrodes requires a higher driving voltage for a display using gas discharge.

Furthermore, a reducing agent such as B (boron) is added to the nickel paste to prevent the nickel from oxidizing during the baking process. This created the problem that the baking condition must be rigidly controlled in order for the agent to work effectively.

SUMMARY OF THE INVENTION

This invention was created in the light of these problems, and therefore, is intended to provide a gas discharge panel capable of being driven at a voltage lower than for conventional panels without mercury injection and capable of having a long service life.

The purpose of this invention is to provide a gas discharge panel with cathode electrodes low in interparticle resistance.

In order to achieve this goal, the gas discharge panel of this invention, is characterized by cold cathode electrodes structured by an element containing an electrically conductive oxide.

For this invention, it is favorable to use a conductive oxide selected from a group of oxides, such as lanthanum chromite ($LaCrO_3$), lanthanum calcium chromite ($La_{1-x}Ca_xCrO_3$, but $0<X<1$), alumina ($Al_2O_3$) doped zinc oxide (ZnO) and antimony (Sb) doped tin oxide ($SnO_2$).

The above-mentioned structure, which uses a conductive oxide of small work function and low sputter rate unlike those of thick nickel film cathode electrodes, can provide a gas discharge panel which works at a lower driving voltage and has a longer service life than conventional gas discharge panels.

In addition, conductive oxides work at a lower current density than a metal such as nickel, so that no discharge concentration occurs and thus the necessity of injecting mercury can be eliminated.

Further, because conductive oxides are stable at elevated temperatures, the gas discharge panel characteristics are not impaired during the various baking steps of the manufacturing process.

Moreover, eliminating the reducing agent improves the flexibility of manufacturing.

Using alumina-doped zinc oxide or antimony doped tin oxide for the conductive oxide creates a cathode electrode with an electric resistance lower than if zinc oxide or tin oxide were used.

DESCRIPTION OF THE EMBODIMENTS

Figure 1:
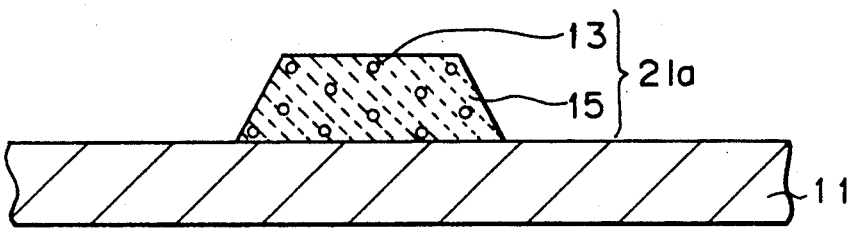
FIG. 1 is a cross-sectional view of the cathode electrodes used in the first and second embodiments of the gas discharge panels of this invention.

Explanations are given hereunder to embodiments of the gas discharge panel according to this invention (hereinafter simply called the panel), with reference to the drawings. Each drawing summarizes the size, shape and arrangement of each component so as to provide a better understanding of the invention. Identical components are given the same reference numerals.

The names of the materials, the parametric conditions for the materials, the quantity, temperature, film thickness and the devices used and mentioned in the following explanations are only a favorable example that can be applied within the range of this invention. Therefore, it should be understood that this invention is not necessarily limited to the conditions described hereunder.

First Embodiment

First an explanation is given on the panel of the first embodiment which uses cathode electrodes structured with conductive oxide particles and a binder made up of glass which has a low melting point.

FIG. 1 is a partial cross-sectional drawing of the substrate in the gas discharge panel of the first embodiment, and the cathode electrode formed on the substrate.

In FIG. 1, the substrate (11) is an insulation substrate or a transparent insulation substrate, for example, a glass substrate generally used in a gas discharge panel.

A cathode electrode (21*a*) is disposed on the glass substrate (11), containing particles of the conductive oxide (13) and a binder (15) made up of a low melting point glass.

In this embodiment, the conductive oxide particles are made of lanthanum chromite ($LaCrO_3$) with a particles size of several μm, and the low melting point glass is the commonly known lead (Pb) glass.

Next, an explanation is given of one example of a method for forming the conductive oxide cathode electrode (21*a*).

First, $LaCrO_3$ is pulverized to a particle size of several μm, with a ball mill. Then, the powder is dried in an oven at 150° C. for a predetermined time. After this, the powder is mixed with lead glass and vehicle to prepare a paste. This embodiment uses a mixing ratio of $LaCrO_3$: Pb glass:vehicle=45:15:40 (percent by weight).

Subsequently, the paste is printed on the glass substrate (11) using a commonly known screen printing process. The element is then baked at a predetermined temperature to obtain the above-mentioned cathode electrode (21*a*).

Second Embodiment

In place of $LaCrO_3$ used in the first embodiment, lanthanum calcium chromite having the composition: $La_{0.8}Ca_{0.2}CrO_3$ is used to fabricate a panel having the lanthanum calcium chromite containing cathode electrode (21*a*) with the same processes as used in the first embodiment.

Because the resistance value of this $La_{1-x}Ca_xCrO_3$ (but $0<X<1$) is lower than $LaCrO_3$, it is possible to suppress increases in the wiring resistance of the cathode electrode when used in a large panel.

Incidentally, $La_{1-x}Ca_xCrO_3$ can be obtained by displacing some of the La in $LaCrO_3$ with Ca. And the relationship between the $La_{1-x}Ca_xCrO_3$ resistance and the Ca displacement amount "X" is disclosed in the "High conductive oxide 'Lanthanum chromite'" publication (by Saburo Ose, Chemical Industry (12. 1974), pp 72–79.) Therefore, lanthanum calcium chromite can easily be obtained with the desired resistance value to design the panel.

Third Embodiment

Next, the third embodiment of the panel is explained where the cathode electrode is composed of a wiring electrode (hereinafter called the base electrode), particles of a conductive oxide and a low melting point glass.

Figure 2:
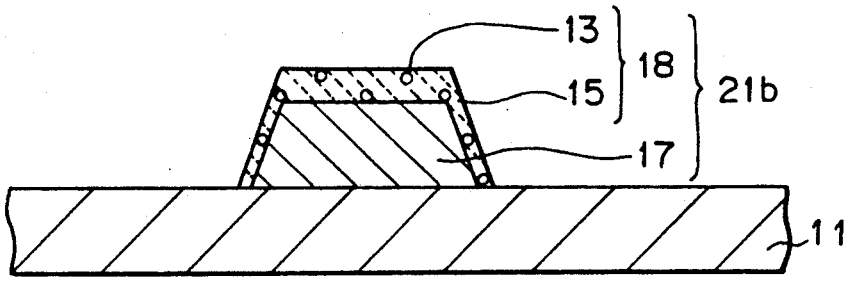
FIG. 2 is a cross-sectional view of the cathode electrodes used in the third and fourth embodiments of the gas discharge panels of this invention.

FIG. 2 is a partial cross-sectional drawing of a gas discharge panel of the third embodiment.

In this gas discharge panel, the base electrode (17) is first disposed on the glass substrate (11) to reduce the wire resistance. An upper electrode (18) is disposed on this base electrode (17), which is composed of the same conductive oxide particles (13) as used in the first embodiment as well as the low melting point glass binder (15). The components (17), (15) and (13) constitute the cathode electrode (21*b*) which contains the conductive oxide particles.

Therefore, the upper electrode (18) is exposed to a discharge space in this structure. The base electrode (17) may consist of various materials, but a thick nickel film is used in this embodiment.

The above-mentioned cathode electrode (21*b*) which is composed of the base electrode (17) and the upper electrode (18) may be formed when a common nickel paste (ESL-#2554 made by Electro Science Laboratories, Inc. (ESL), for example) is pasted on the glass substrate (11) by the screen printing process, then baked to form the thick nickel film base electrode (17), over which the $LaCrO_3$ containing paste (as prepared in the first embodiment or the $La_{0.8}Ca_{0.2}CrO_3$ containing paste as prepared in the second embodiment) is printed and baked to form the cathode electrode (21*a*).

While a conductive oxide has a high conductivity, the structure according to the third embodiment can further reduce the wire resistance in the drawn-around wiring, thus the oxide is effective when it is used to fabricate large panels. The paste may be applied on the entire surface of the base electrode (17) or only on the part corresponding to the display cell in the base electrode (17).

Further explanation is given of the panel's third embodiment with a cathode electrode made of a $La_{0.8}Ca_{0.2}CrO_3$ containing paste.

Figure 3A:
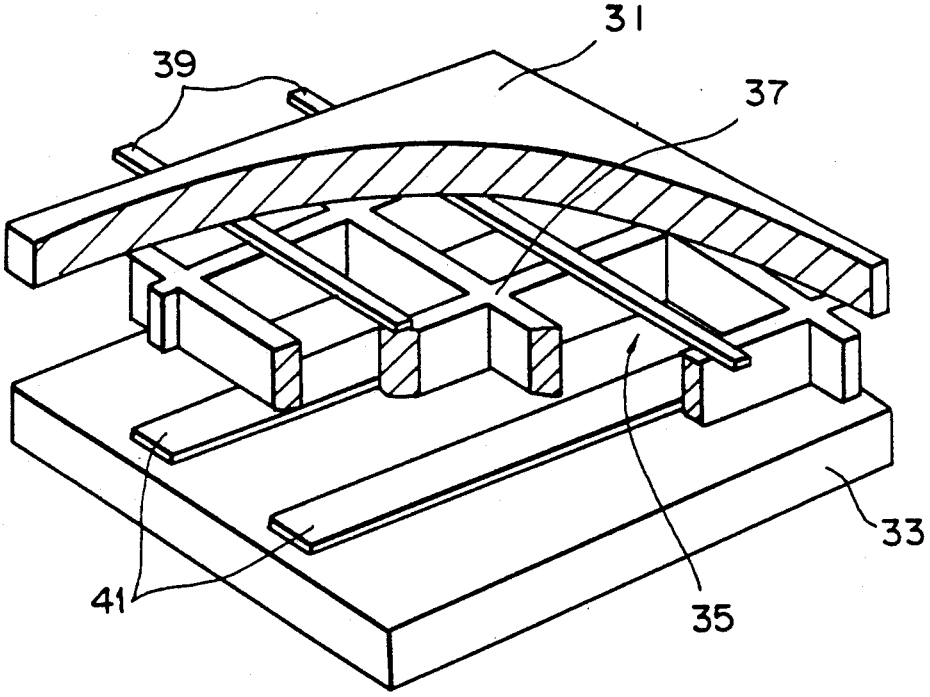
FIG. 3(A) is a partially cut-out perspective view of the third and fourth embodiments of the gas discharge panel to explain this invention.

FIG. 3(A) is a perspective view summarizing the panel with its essential part partly cut out.

This panel has a front substrate (31), a rear substrate (33) opposing the substrate (31), an inter-cell partition (37) between the substrates (31) and (33) which defines individual display cells (35), anode electrodes (39) located on the front substrate (31), and cathode electrodes (41) located on the rear substrate (33). Here, the cathode electrode (41) is composed, as shown in FIG. 2, of the base electrode (17), and the upper electrode (18) laminated on the base electrode, which contains $La_{0.8}Ca_{0.2}CrO_3$.

Further, this panel is disposed with a light shielding film on parts other than the display cells of the rear substrate (31), an anode overcoat layer covering parts other than the display part of the anode electrode (39) on the front substrate (31), and a cathode overcoat layer covering parts other than the display part of the cathode electrode (41) on the rear substrate (33). In addition, He-2% Xe (percent by volume) gas mixture is injected as the discharge gas at a pressure of 200 Torr, between the front and rear substrates (31) and (33).

Figure 3B:
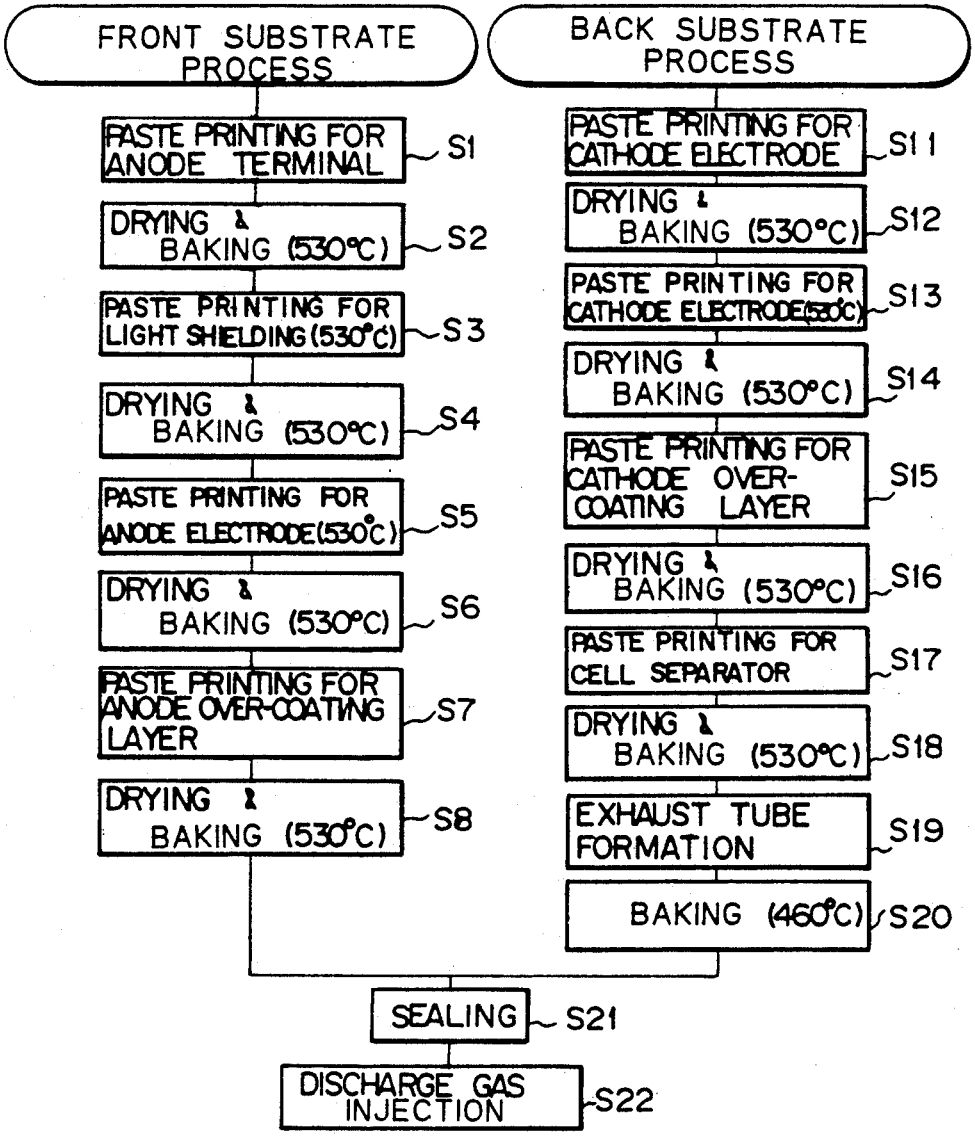
FIG. 3(B) summarizes the manufacturing process flow chart for the panel fabricated using the third and fourth embodiments of this invention.

This panel is fabricated using the thick film printing technique. A summarized process flow chart for panel fabrication is shown in FIG. 3 (B). A rough explanation would be: the front substrate components are formed on the front wall or substrate in the steps S1 through S8, the rear wall or substrate components are formed on the rear substrate in the steps S11 through S19, then both substrates are bonded (step S21), and then the discharge gas is injected between both substrates (step S22).

The paste used in fabricating each component in this panel includes those listed in Table 1.

TABLE 1

(List of pastes used in fabricating panels of the embodiments)

| Name of component | Name of thick film (produce name and manufacturer) |
|---|---|
| Anode terminal | Thick silver film (ESL-#590, made by Electro-Science Laboratories Inc.) |
| Light shielding film | Black paste (Okuno 503, made by Okuno Chemical Industries Co.) |
| Anode electrode | Thick nickel film (ESL-#2554, made by the same manufacturer as for the thick silver film for the anode terminal) |
| Anode overcoat | Thick dielectric film (9741, made by Du Pont) |
| Cathode terminal | Thick silver film (the same thick silver film as used in the anode terminal) |
| Wiring (base) electrode[1] | Thick nickel film (the same thick nickel film as used in the anode electrode) |
| Cathode overcoat | Thick dielectric film (the same thick dielectric film as used in the anode overcoat) |
| Inter-cell partition | Thick dielectric film (the same thick dielectric film as used in the anode overcoat) |
| Cathode (upper) electrode[2] | $Ca_{0.2}La_{0.8}CrO_3$ thick film shown in Table 3. |

[1]The wiring (base) electrode corresponds to a cathode electrode in the conventional panels.
[2]The cathode upper electrode is an electrode laminated on the wiring (base) electrode, as provided by this invention.

These components have the thickness as shown in Table 2.

TABLE 2

(Film thickness of thick films constituting each component)

| Name of component | Film thickness (μ) |
|---|---|
| Anode terminal | 13 |
| Light shielding film | 28 |
| Anode electrode | 28 |
| Anode overcoat | 26 |
| Cathode terminal | 13 |
| Wiring (base) electrode | 28 |
| Cathode overcoat | 27 |
| Inner-cell partition | 160 |
| Cathode (upper) electrode | 10–30 |

The upper electrode (18) on the cathode electrode (41) uses three kinds of paste, shown as I through III in FIG. 3, which have different compositions.

TABLE 3

(Detail of composition of cathode (upper) electrode pastes)

| Paste No. | Mixing ratio of each constituent (Percentage by weight) | | |
|---|---|---|---|
| | $La_{0.8}Ca_{0.2}CrO_3$ | Lead glass | Vehicle |
| I | 40.5 | 13.6 | 45.9 |
| II | 43.7 | 20.2 | 36.1 |
| III | 27.1 | 35.3 | 37.6 |

In Table 1, the anode terminal is placed in a predetermined location on the anode electrode (39), thereby connecting the anode electrode with an external driving circuit. The cathode terminal is place in a predetermined location on the cathode electrode (41), thereby connecting the cathode electrode with an external driving circuit.

Panels using different kinds of paste for the upper electrode on the cathode electrode (41), panels injected with mercury between the front and rear substrates, and panels not injected with mercury are fabricated to serve as the panels of the embodiments.

Further, a panel with a cathode electrode (41) having no upper electrode (18), (i.e., structured only with the base electrode (17) made of nickel) is injected with mercury between the front and rear substrate, and fabricated to serve as a conventional panel. These panels are measured to obtain the characteristics of the discharge current (μA per cell) versus applied voltage (V).

Figure 4:
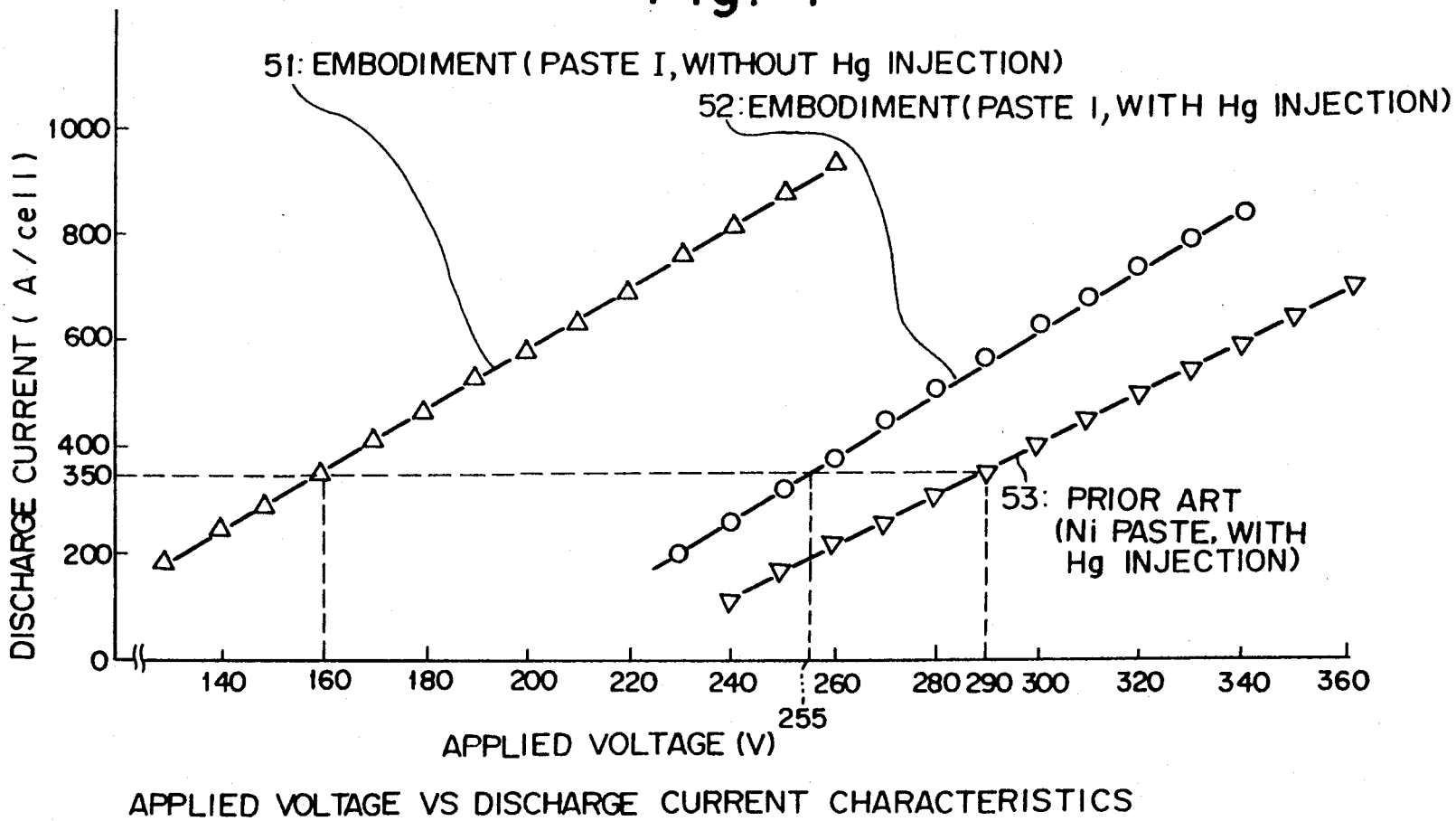
FIG. 4 is a graph showing the panel discharge characteristics in the third embodiment of this invention and the conventional case.

FIG. 4 is a characteristics graph with the applied voltage presented on the axis of the abscissa, and the discharge current on the axis of the ordinate. In FIG. 4, the plotted line (51) shows the characteristics of the panel that uses the upper electrode (18) formed using Paste No. I in Table 3 and is injected with no mercury. The plotted line (52) shows the characteristics of the panel that uses the upper electrode (18) formed using Paste No. I in Table 3 and is injected with mercury. The plotted line (53) shows the characteristics of the conventional panel.

Because the discharge current flowing into one display cell and the luminance in a gas discharge panel are proportional, a high discharge current should be obtained at a low applied voltage. As seen in FIG. 4, the voltage required for a discharge current of 350 μA per cell is 160 V for a display cell in the embodiment without mercury injection, 225 V for a display cell in the embodiment with mercury injection, and 290 V for a display cell in the conventional panel. This explains how the display cell in the embodiment using $Ca_{0.2}La_{0.8}CrO_3$ can reduce the voltage by as much as 35 V in cases of mercury injection, and by 130 V in the cases without mercury injection, as compared to the display cell in the conventional panel.

Figure 5:
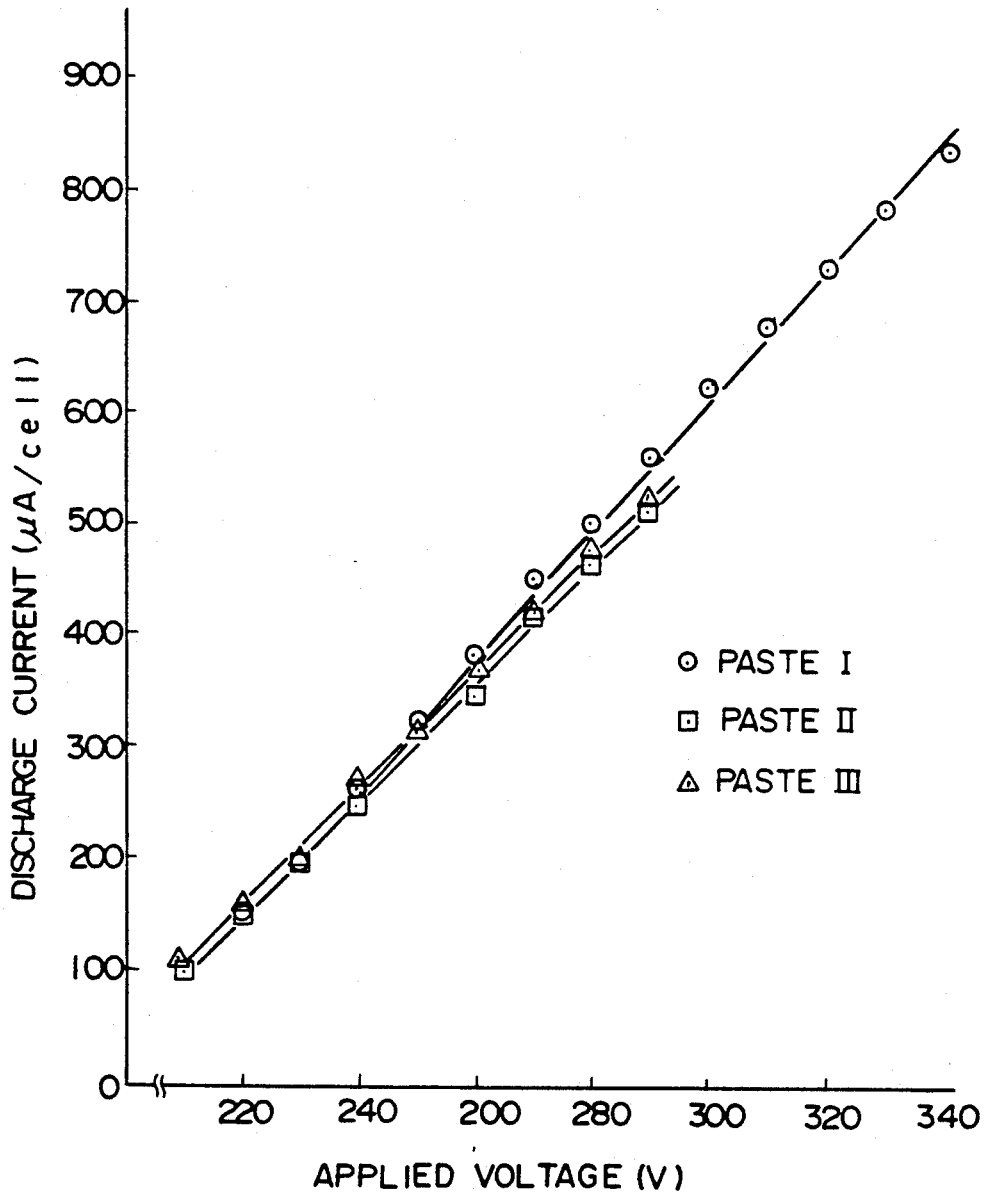
FIG. 5 is a graph comparing the relationship of the gas discharge panel in the third embodiment with the discharge characteristics.

FIG. 5 is a graph showing applied voltage versus the discharge current characteristics for one display cell in the panels fabricated using three kinds of paste, I through III, as shown in Table 3. Each of the panels is injected with 5 μl of mercury.

As seen in FIG. 5, each panel in the present invention shows identical characteristic independent of the amount of lead glass in the paste. Therefore, while in the conventional nickel paste the many panel characteristics vary greatly when the lead glass content in the paste is changed (hence making it very important to control the paste) the present invention can alleviate such control conditions. This is probably because when a thick nickel film is used, the resistance value changes according to the degree to which the nickel particles are oxidized, the inter-particle resistance varies when the lead glass content is changed, and the cubic volume of the thick film in the part composed of lead glass and the gas generated from a reducing agent that is impregnated in the thick film changes, thus varying the resistance value of the thick film. On the other hand, $La_{1-x}Ca_xCrO_3$ has high resistance to oxidation, eliminates the need for a reducing agent, and causes no surface oxidation.

Fourth Embodiment

Next, panels in the fourth embodiment are fabricated as explained hereunder, using zinc oxide (ZnO) doped with alumina ($Al_2O_3$) at 0.5% by weight (hereinafter referred to as the alumina-doped ZnO) instead of the $La_{0.8}Ca_{0.2}CrO_3$ used in the third embodiment. The alumina-doped ZnO used in this embodiment is made through use of a coprecipitation phenomenon such as the one made by the High Purity Chemistry Research center (in which alumina is contained in ZnO).

In preparing the paste, the alumina-doped ZnO and the lead glass are adjusted so that the alumina-doped ZnO content in the upper electrode (18) would be 90% by weight at baking. Two types of paste are prepared by using the alumina-doped ZnO with different particle distribution. For the sake of clarity, the alumina-doped ZnO with one type of distribution will hereinafter be called paste sample I and the other type of distribution will be called paste sample II. Table 4 shows the particle distribution of these two kinds of alumina-doped ZnO.

TABLE 4

(Particle distribution in each of two kinds of alumina-doped ZnO)

| | Paste sample I | Paste sample II |
|---|---|---|
| 70% of entirety is: | $\phi \leqq 3$ μm | $\phi \leqq 0.5$ μm |
| 29% of entirety is: | $3 < \phi \leqq 15$ μm | $0.5 < \phi \leqq 1$ μm |
| 1% of entirety is: | $\phi > 15$ μm | $\phi > 1$ μm |

Symbol $\phi$ in Table 4 denotes the particle diameter.

Next, the gas discharge panels are fabricated by using the above two kinds of alumina-doped ZnO under the same conditions as in the third embodiment, to serve as panels for the embodiment. However, none of the panels in these embodiments uses a mercury injection.

Subsequently, measurements are taken of these panels to obtain the characteristics of the discharge current (μA per cell) versus the applied voltage (V).

Figure 6:
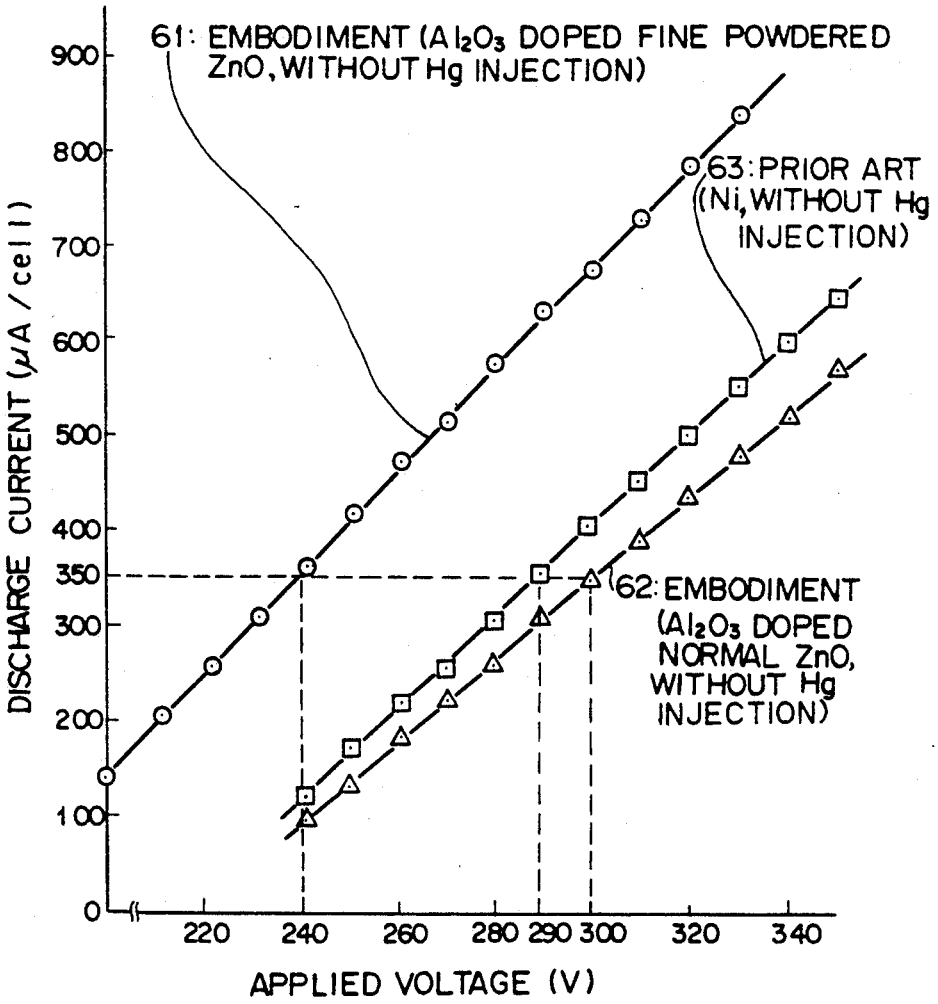
FIG. 6 is a graph showing the discharge characteristics of the gas discharge panel in the fourth embodiment and conventional case.

FIG. 6 shows the applied voltage versus discharge current characteristics of each panel fabricated by using alumina-doped ZnO, and those of the conventional panel (as shown on plotted line (53) in FIG. 4). In FIG. 6 the plotted line (61) shows the characteristics of the panel formed with the upper electrode using paste sample I. The plotted line (62) shows the characteristics of the panel formed with the upper electrode using paste sample II, and the plotted line (63) shows the characteristics of the conventional panel.

As FIG. 6 shows the voltage required to flow a discharge current of 350 μA per cell is 240 V for the panel of the embodiment using sample II, 300 V for the panel of the embodiment using sample I, and 290 V for the conventional panel. This demonstrates that the panel using sample I has a voltage higher by 10 V than does the conventional panel, and the panel using sample II has a voltage lower by 50 V than does the conventional panel.

The reason that the panel using paste sample II had the lower operating voltage, notwithstanding that it used the same amount of lead glass for each panel of the embodiment, is believed to be that the specific surface area (surface area/cubic volume) which increased as much as the more finely pulverized alumina-doped ZnO particles, relatively reduced the amount of lead glass. In other words, it is believed that as much lower voltage was realized as a result of an increase in the specific surface area.

While the panels using paste sample I showed discharge characteristics identical with those of the conventional panel, they differed from the conventional panel in that the panels of each embodiment achieve the discharge characteristics equivalent to or better than those of the conventional panel, all without mercury injection. Therefore, it is understood that the panels of the embodiments are superior to the conventional panel in terms of environmental protection and cost reduction.

Figure 7:
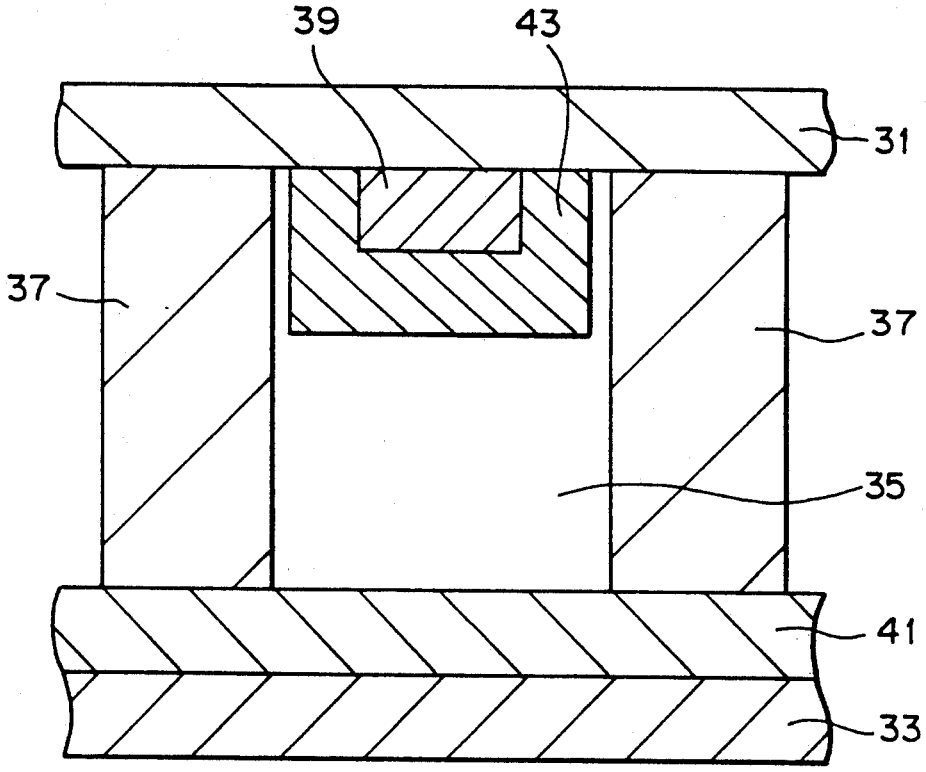
FIG. 7 is a cross-sectional view of the essential parts of the multicolored gas discharge panel fabricated according to the fourth embodiment.
Figure 8A:
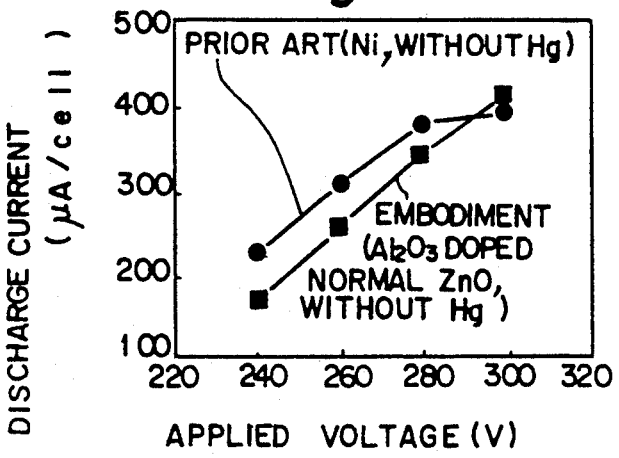
FIGS. 8(A) through (D) are the discharge characteristics graphs for the multicolored panel in the fourth embodiment and conventional case.
Figure 8B:
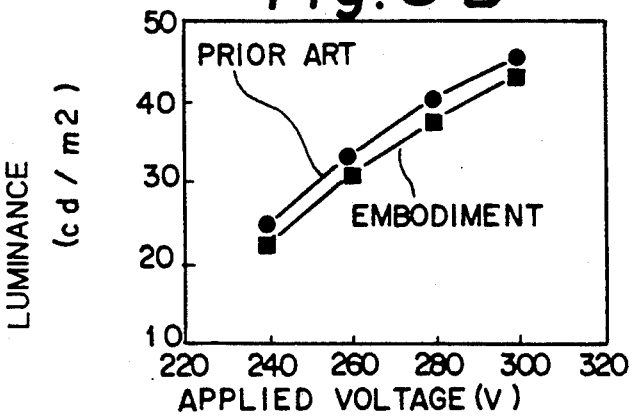
Figure 8C:
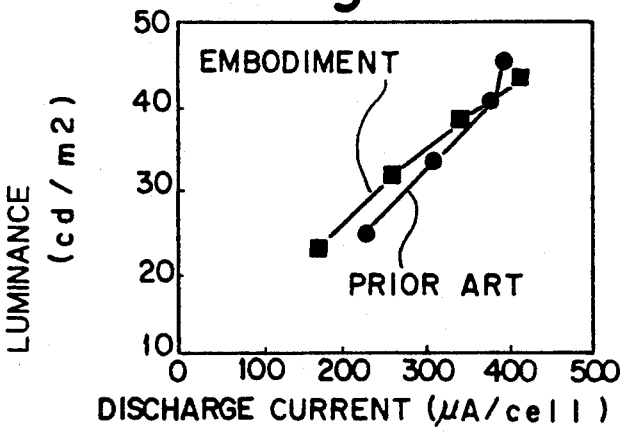
Figure 8D:
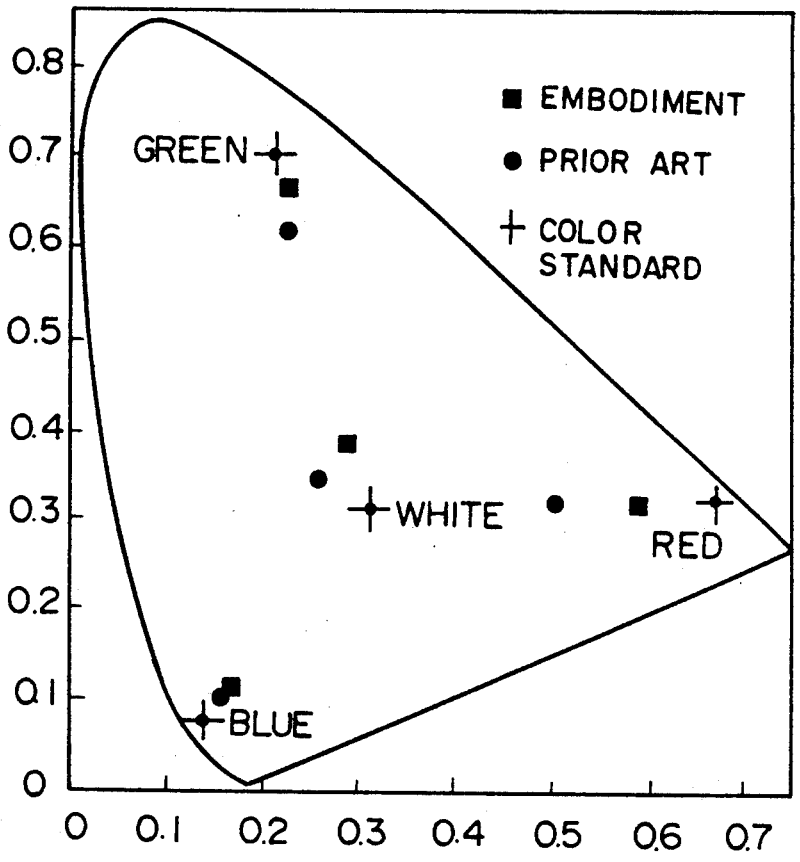

Next, a 9-inch multicolored panel disposed with an upper electrode formed by using the sample paste I is fabricated. The number of display cells is 480 (160 red, 160 green and 160 blue)×120. FIG. 7 is a cross-sectional drawing summarily showing one display cell on the panel, cut out in the direction of the panel thickness. The basic structure of this panel differs from the panel shown in FIG. 3 on the following points:

First, on the front substrate (31) side of each display cell (35), there is a fluorescent element (43) which responds to the colors operated by the display cell (red, green or blue). The fluorescent elements which are used are shown in Table 5.

TABLE 5

| (Fluorescent elements used on the fabricating panel of the embodiment) | | | |
|---|---|---|---|
| Color | Product name | Chemical formula | Remarks |
| Red | KX504A | $(Y, Gd)BO_3:Eu$ | All the fluorescent |
| Green | P1G1 | $Zn_2SiO_4:Mn$ | elements are made by |
| Blue | KX501A | $BaMgAl_{14}O_{23}:Eu$ | Kasei Options Co. |

The paste used to form the fluorescent element providing conductivity to the element was composed of the fluorescent element: indium oxide powder ($In_2O_3$ powder, made by Dowa Chemical): screen oil (6009, made by Okuno Chemical)=2: 1: 5.

The anode electrode (39) is an indium-tin-oxide vaporized film with a film thickness of 2000 Å.

The multicolored panel in this embodiment is driven by an IC with a withstand voltage of 330 V. Therefore, if He-Xe is used as a discharge gas, the panel coated with a fluorescent element cannot emit light over the entire panel surface, at the voltage supplied from the IC. As a result, the panel is injected with a He-Kr gas mixture that can discharge at a lower voltage than for the He-Xe. Incidentally, no mercury is injected into the panel of the embodiment.

The multicolored gas discharge panel fabricated under the above conditions is measured for (1) applied voltage versus discharge current characteristics, (2) applied voltage versus luminance characteristics and (3) discharge current versus luminance characteristics. Also a chromaticity chart is drawn. To take the luminance measurement, a color luminance meter BM-5 (made by Topcon) was used. In addition, a multicolored conventional gas discharge panel is fabricated under the same conditions as the embodiment, except that the cathode electrode is constructed with only thick-film nickel, and injected without mercury, to measure the various discharge characteristics as is done in the embodiment, as well as to draw a chromaticity chart.

FIG. 8 (A) is a graph with the applied voltage (V) presented on the axis of the abscissa, and the discharge current (μA per cell) presented on the axis of the ordinates to show the applied voltage versus the discharge current characteristics of the multicolored panels of the embodiment and of the conventional type.

FIG. 8 (B) is a graph with the applied voltage (V) presented on the axis of the abscissa, and the luminance ($cd/m^2$) presented on the axis of the ordinates to show the applied voltage versus luminance characteristics of the multicolored panels of the embodiment and of the conventional type.

FIG. 8 (C) is a graph with the discharge current (μA per cell) presented on the axis of the abscissa, and the luminance ($cd/m^2$) on the axis of the ordinates to show the characteristics of the multicolored panels of the embodiment and of the conventional type.

FIG. 8 (D) is a chromaticity chart of the multicolored panels of the embodiment and of the conventional type.

As can be seen from FIG. 8 (A), the conventional multicolored panel produces a higher discharge current than by the panel of the embodiment, when a voltage of a similar magnitude is applied. This agrees with the result of measurement of a case in which fluorescent element is provided (the relation between plotted line (62) and plotted line (63) in FIG. 6).

Because the conventional panel is capable of achieving a higher discharge current than the panel of the embodiment under the same voltage, the conventional panel also achieves, as shown in FIG. 8 (B), a higher luminance under the same voltage. However, the difference is so small that it can be treated as practically equivalent. In addition, since the characteristics of the panel of the embodiment can be largely improved by changing the alumina-doped ZnO to the sample paste II, as required, the panel of the embodiment has no problem in this respect.

The luminance will normally be the same if the discharge current is the same, but, as can be seen from FIG. 8 (C), the luminance under a similar discharge current is higher in the embodiment panel than in a conventional panel. The cause for this is believed to be that the ZnO used in the embodiment is white and, therefore, raises the reflection at the display cell to a degree higher than that in the conventional panel.

In addition, as FIG. 8 (D) shows, the embodiment panel provides colors closer to the standard colors than does the conventional panel. In particular, red is much closer to the standard color in the embodiment panel. The reason the embodiment panel produces colors closer to the standard is believed to be that the embodiment panel is not injected with mercury.

The above-mentioned features, dearly indicate that when the present invention is applied to a multicolored panel, mercury is eliminated and the chromaticity is improved.

While the fourth embodiment uses alumina-doped ZnO as a conductive oxide, the same effect as that in the fourth embodiment can be expected if the antimony-doped tin oxide is used as the conductive oxide.

Fifth Embodiment

An explanation is given for the panel of the fifth embodiment, in which a cathode electrode containing conductive oxide is constructed by using a base electrode and a conductive oxide film.

Figure 9:
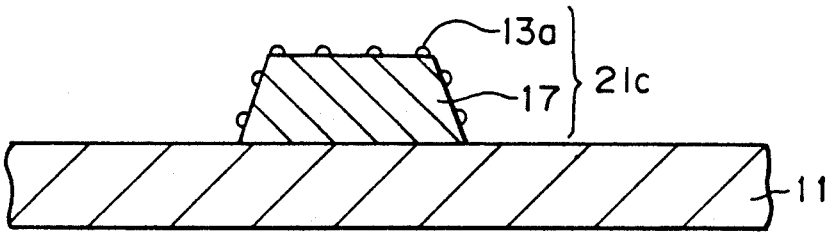
FIG. 9 is a cross sectional view of the cathode electrode used in the gas discharge panel of the fifth embodiment.

FIG. 9 is a partial cross-sectional drawing of the gas discharge panel of the fifth embodiment, showing it in a similar manner as in FIG. 1.

The gas discharge panel of the fifth embodiment has a base electrode (17) on the glass substrate (11). The base electrode (17) surface is deposited with a conductive oxide film (**13*a*). These components (17) and (13*a*) constitute the cathode electrode (21*c***) containing the conductive oxide film.

Since $LaCrO_3$ is used as a conductive oxide, the cathode electrode (**21*c***) according to the fifth embodiment may be formed by using a plating process and a heat treatment process as described below.

First a plating liquid containing La $(NO_3)_3$ at 0.1 mol/l and $(NH_4)_2$ $CrO_7$ at 0.1 mol/l, at pH of 2.3 is prepared. The base electrode (17) is formed on the glass substrate (11) by using a screen printing process in a manner similar to that in the third embodiment.

Next, the glass substrate (11) formed with a base electrode (17) is immersed in the above plating liquid, and plated using a constant-voltage electrolytic plating method in a still condition at room temperature at a voltage of −1.5V (SCE: saturated calomel electrode referenced). Then, the sample piece is heat treated.

This procedure allows the $LaCrO_3$ film (**13*a*) to be deposited on the surface of the base electrode (17**).

This embodiment uses the atmosphere as an environment for the post-plating heat treatment. Because the substrate is a glass substrate, the temperature of the above heat treatment was maintained at approximately 600° C.

If heat treatment at higher temperatures is desired, it is preferable to build a substrate with highly heat-resistant alumina silicate glass, (for example, Corning 0317 made by Corning). Also, the heat treatment may include a lamp-annealing or laser-annealing process to prevent damage to the substrate.

Sixth Embodiment

An explanation is provided for the panel of the sixth embodiment, in which a cathode electrode containing a conductive oxide is constructed by using a base electrode and conductive oxide particles as well as a binder.

Figure 10:
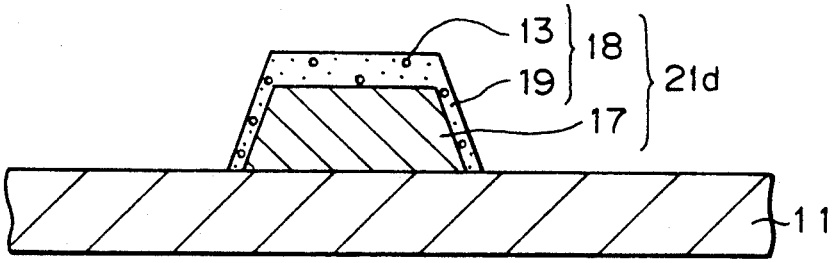
FIG. 10 is a cross sectional view of the cathode electrode used in the gas discharge panel of the sixth embodiment.

FIG. 10 is a partial cross-sectional drawing of a gas discharge panel of the sixth embodiment. This panel is shown in a manner similar to that shown in FIG. 1.

The gas discharge panel of the sixth embodiment is disposed with a base electrode (17) on the glass substrate (11). The base electrode (17) is located on it and the upper electrode (18) is composed of conductive oxide particles (13) and a metal binder (19). These components (17), (13) and (19) constitute the cathode electrode (21*d*) containing the conductive oxide film.

Explained by the fact that $LaCrO_3$ is used as a conductive oxide, the cathode electrode (21*d*), according to the sixth embodiment, may be formed by using the process described below.

First, the $LaCrO_3$ particles prepared in the first embodiment are mixed into well known metal organic paste, to prepare a metal organic paste containing $LaCrO_3$ particles. Then, the base electrode (17) consisting of thick nickel film is formed on the glass substrate (11) through the screen printing process in a manner similar to that described in the third embodiment.

Next, the glass substrate (11) formed with the base electrode (17) is printed with the metal organic paste containing $LaCrO_3$ particles by using screen printing process, followed by predetermined baking to obtain the cathode electrode (21*d*).

While there are various kinds of metal organic paste that can be mixed with $LaCrO_3$, this embodiment used ITO paste (ESL-#3050, made by ESL Inc., ). When the ITO paste is used, ITO ($In_2O_3$: Sn) serves as the binder (19).

Seventh Embodiment

An explanation is provided for the panel of the seventh embodiment, in which a cathode electrode containing conductive oxide is constructed by using conductive oxide particles and a metal binder. This structure corresponds to the one for the sixth embodiment excluding the base electrode (17), and is especially suitable when the metal binder (19) has a low resistance.

Figure 11:
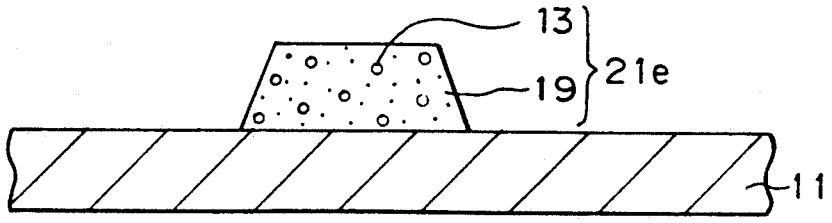
FIG. 11 is a cross sectional view of the cathode electrode used in the gas discharge panel of the seventh embodiment.

FIG. 11 is a partial cross-sectional drawing of a gas discharge panel of the seventh embodiment, showing it in a manner similar to that shown in FIG. 1.

The gas discharge panel of the seventh embodiment consists of the base electrode (21*e*) constructed on the glass substrate (11), by using the conductive oxide particles (13) and the metal binder (19).

The cathode component (21*e*) of the seventh embodiment can be formed by preparing a metal organic paste containing gold (Au) or silver (Ag) mixed with $LaCrO_3$ particles, which is pasted with a screen-printing process onto the glass substrate (11), which is then baked.

Glass with a low melting point was used as a binder in the first embodiment, but the paste described below can be used to form the electrode.

The paste used as the binder comprises a binder-forming liquid containing a material that forms both a layer of conductive oxide (such as tin oxide) as the binder layer, and conductive oxide particles as the conductive particles (such as ITO (Indium-tin-oxide) particles). Moreover, the binder-forming liquid contains a doping agent for making resistance adjustments.

An explanation of this embodiment is given hereunder in further detail.

This paste is made by mixing a binder-forming liquid to form a layer made up of ITO particles and tin oxide, with a vehicle to improve printability of the paste.

The binder-forming liquid is made from organic tin, such as acetylacetone tin $\{Sn\ (C_4H_9)_2\ (C_5H_7O_2)\}$, dissolved into an alcohol solution, such as a butanol solution. Then fluorine and antimony is added to binder-forming liquid as a doping agent. Otherwise, a thin tin-oxide film-forming liquid containing fluorine and antimony as the binder-forming liquid (FATO, made by Japan Chemical Industry Co.) is used. The use of such a binder-forming liquid allows a binder layer of tin-oxide doped with fluorine and antimony to be formed. The binder layer is built from the binder-forming liquid when the paste is baked.

The ITO particles used are an ultra-fine powder with an average particle size of 500 Å. The vehicle used is ESL-#405 (made by Electro Science Laboratories Inc.)

The binder-forming liquid, the ITO particles and the vehicle are put together in a roll mill to be mixed to form a paste. The paste is composed of ITO particles (30 to 70% by weight), a binder-forming liquid (10 to 50% by weight), and the vehicle (30 to 60% by weight). The optimum composition takes into account the size and resistance of the particles and the resistance of the binder layer. If the particle size is small, the total surface area of the particles increases, making the specific surface area relative to other components larger. Hence the amount of the binder-forming liquid is raised in order to increase the ratio of the binder layer to the paste. This paste is mixed with conductive oxide and then printed on the glass substrate using a screen-printing process. Then the printed area is baked at a predetermined temperature to convert it into a cathode electrode.

As can be clearly understood from the above explanation, the gas discharge panel of this invention, which has a cathode electrode structured with components containing conductive oxide, can produce the desired luminance at a lower driving voltage than for conventional panels. A gas discharge panel, with a long service life can thereby be obtained without using mercury.

We claim:

1. A gas discharge panel, comprising a plurality of cathode and anode electrodes disposed to emit light as a result of gas discharges between the cathode and anode electrodes, wherein each of said cathode electrodes comprises an element that includes electrically conductive oxide particles and a binder which binds said particles.

2. A gas discharge panel as claimed in claim 1, wherein said electrically conductive oxide particles are particles of lanthanum chromite ($LaCrO_3$).

3. A gas discharge panel as claimed in claim 1, wherein said electrically conductive oxide particles are particles of lanthanum calcium chromite ($La_{1-x}Ca_xCrO_3$, $0<X<1$).

4. A gas discharge panel as claimed in claim 1, wherein said electrically conductive oxide particles are particles of zinc oxide (ZnO) that are doped with alumina ($Al_2O_3$).

5. A gas discharge panel as claimed in claim 1, wherein said electrically conductive oxide particles are particles of tin oxide ($SnO_2$) that are doped with antimony (Sb).

6. A gas discharge panel comprising a plurality of cathode and anode electrodes disposed to emit light as a result of gas discharges between the cathode and anode electrodes, wherein each of said cathode electrodes comprises an element that includes electrically conductive oxide particles and a binder which binds the particles, said binder containing electrically conductive material.

7. A gas discharge panel as claimed in claim 6, wherein said binder contains dopant to adjust the resistance of said particles and said binder.

8. A gas discharge panel as claimed in claim 6, wherein said electrically conductive material is metal oxide.

9. A gas discharge panel as claimed in claim 6, wherein said electrically conductive material is metal.

10. A gas discharge panel as claimed in claim 6, further comprising a front substrate, a rear substrate bonded to said front substrate, an inter-cell partition disposed between said front and rear substrates, said partition defining individual display cells, each cell including a respective one of said anode electrodes and a respective one of said cathode electrodes, the anode and cathode electrodes of each cell being disposed spaced from each other to emit light as a result of a gas-discharge therebetween.

11. A gas discharge display panel as claimed in claim 1, wherein said cathode electrode consists essentially of said element.

12. A gas discharge display panel as claimed in claim 11, wherein said element consists essentially of said electrically conductive oxide particles and said binder.

13. A gas discharge display panel as claimed in claim 11, wherein said cathode electrode further comprises a base electrode, said element forming an upper electrode disposed on said base electrode.

14. A gas discharge display panel as claimed in claim 13, wherein said element consists essentially of said electrically conductive oxide particles and said binder.

15. A gas discharge panel, comprising a front substrate, a rear substrate bonded to said front substrate, an inter-cell partition disposed between said front and rear substrates, said partition defining individual display cells, each cell being filled with a gas and including at least an anode electrode and a cathode electrode disposed spaced from each other with the gas therebetween to emit light as a result of a gas-discharge therebetween, each cathode electrode having an element which includes electrically conductive particles and a binder which binds said particles.

16. A gas discharge display panel as claimed in claim 15, wherein in each cell said cathode electrode consists essentially of said element.

17. A gas discharge display panel as claimed in claim 16, wherein said element consists essentially of said electrically conductive oxide particles and said binder.

18. A gas discharge display panel as claimed in claim 15, wherein said cathode electrode further comprises a base electrode, said element forming an upper electrode disposed on said base electrode.

19. A gas discharge display panel as claimed in claim 18, wherein said element consists essentially of said electrically conductive oxide particles and said binder.

20. A gas discharge panel, comprising a plurality of cathode and anode electrodes disposed to emit light as a result of gas discharges between the cathode and anode electrodes, wherein each of said cathode electrodes is a cold cathode electrode which comprises an element that includes an electrically conductive oxide.

21. A gas discharge panel as claimed in claim 20, wherein said electrically conductive oxide is lanthanum chromite ($LaCrO_3$).

22. A gas discharge panel as claimed in claim 20, wherein said electrically conductive oxide is lanthanum calcium chromite ($La_{1-x}Ca_xCrO_3$, but $0<X<1$).

23. A gas discharge panel as claimed in claim 20, wherein said electrically conductive oxide is zinc oxide (ZnO) that is doped with alumina ($Al_2O_3$).

24. A gas discharge panel as claimed in claim 20, wherein said electrically conductive oxide is tin oxide ($SnO_2$) that is doped with antimony (Sb).

25. A gas discharge panel as claimed in claim 20, wherein said cathode electrode further comprises a base electrode, said element forming an upper electrode disposed on said base electrode.

* * * * *